United States Patent [19]

Fujiura

[11] Patent Number: 4,938,704

[45] Date of Patent: Jul. 3, 1990

[54] ELECTRICAL CONNECTOR SHIELDED MEMBER HAVING MOUNTING MEANS

[75] Inventor: Yoshitsugu Fujiura, Tokyo, Japan

[73] Assignee: AMP Incorporated, Harrisburg, Pa.

[21] Appl. No.: 354,189

[22] PCT Filed: Mar. 25, 1988

[86] PCT No.: PCT/US88/00940

§ 371 Date: Nov. 8, 1988

§ 102(e) Date: Nov. 8, 1988

[87] PCT Pub. No.: WO88/08627

PCT Pub. Date: Nov. 3, 1988

[30] Foreign Application Priority Data

Apr. 30, 1987 [JP] Japan ..... 62-066243

[51] Int. Cl.[5] ..... H01R 13/639

[52] U.S. Cl. ..... 439/95; 439/607

[58] Field of Search ..... 439/92, 95, 607, 608, 439/609, 101, 108, 610

[56] References Cited

U.S. PATENT DOCUMENTS

| | | | |
|---|---|---|---|
| 4,512,618 | 4/1985 | Kumar | 439/607 |
| 4,637,669 | 1/1987 | Tajima | 439/95 |
| 4,699,438 | 10/1987 | Kikuta | 439/95 |

FOREIGN PATENT DOCUMENTS

| | | | |
|---|---|---|---|
| 180284 | 5/1986 | European Pat. Off. | 439/92 |

*Primary Examiner*—William Briggs

*Attorney, Agent, or Firm*—Adrian J. LaRue

[57] ABSTRACT

A shield member for mounting onto an electrical connector comprises a shield section secured onto a dielectric housing with integral leg sections of the shield section being disposed in slots of the housing and mounting members integral with the leg sections extending through slots in housing and outwardly from a bottom surface of housing for engagement with hole in a circuit board.

5 Claims, 1 Drawing Sheet

ELECTRICAL CONNECTOR SHIELDED MEMBER HAVING MOUNTING MEANS

BACKGROUND OF THE INVENTION

The present invention is related to an electrical connector and particularly to an electrical connector shield member for mounting onto an electrical connector and having mounting means for mounting an electrical connector to a circuit board.

U.S. Pat. No. 4,679,883 discloses a right angle connector having a metal shield surrounding the mating face. Ground straps integral with the metal shield extend to respective mounting faces. An eyelet passes through apertures in a flange and through the ground strap to secure the connector to a printed circuit board and simultaneously provide an electrical path from the metal shield to a ground on the printed circuit board. Thus, for an electrical connector to be mounted on a circuit board and requiring electromagnetic shielding, the connector included a shield member for shielding the connector and separate mounting members for mounting the shielded connector to a circuit board.

Accordingly, a problem arose in that a large number of man-hours was needed for manufacturing and assembly of such a connector. Furthermore, the ground connection between the shield member and the circuit board was not reliable.

The purpose of this invention is to provide a shield member having excellent electrical characteristics, and which is easily assembled by manufacturing the shield member and the mounting members integrally as one member thereby avoiding the possibility of an incomplete electrical connection between two separate parts. Further, the man-hours required for the assembly can be reduced since the integrally-formed shield member with mounting members is easily fitted to the connector housing and secured thereon. The resulting electrical connector assembly can be readily mounted onto a circuit board.

SUMMARY OF THE INVENTION

In accordance with the present invention, a shield member comprises a shield section covering a front surface of a connector housing and mounting members for mounting an electrical connector onto and to a circuit board. The invention is characterized in that the shield member and mounting members are integrally formed from a sheet of suitable conductive metal, and, on the shield section and at the end of the mounting members, securing sections are provided for securing the shield member to the connector housing.

Accordingly, a shield member can be made by which the possibility of an incomplete connection between the shield member and the mounting members is avoided, the man-hours required for assembly of the shield member onto a connector housing and for mounting the connector onto a circuit board are reduced. Furthermore, a more reliable ground connection can be obtained between a ground plane on the circuit board when the connector is mounted thereon.

Moreover, a further improved assembly process and electrical connection is ensured since the mounting members can be directly soldered to the ground plane by applying surface processing to the conductive material to obtain good solderability therebetween.

The invention will now be described by way of example with reference to the following detailed description of the invention in conjunction with the accompanying drawing

DETAILED DESCRIPTION OF PREFERRED EMBODIMENT

Figure 2:
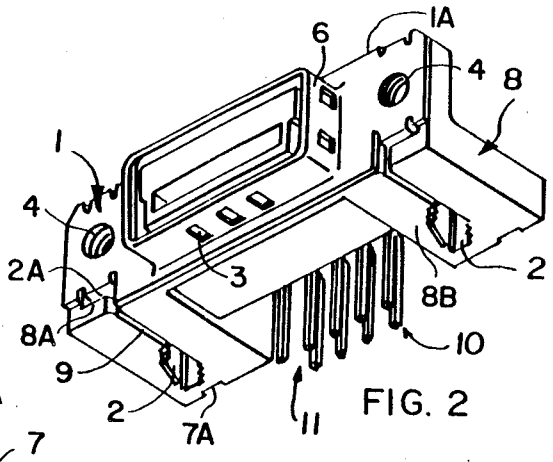
FIG. 2 is a perspective view showing the shield member according to the present invention assembled to the connector housing thereby forming a shielded electrical connector.
Figure 1:
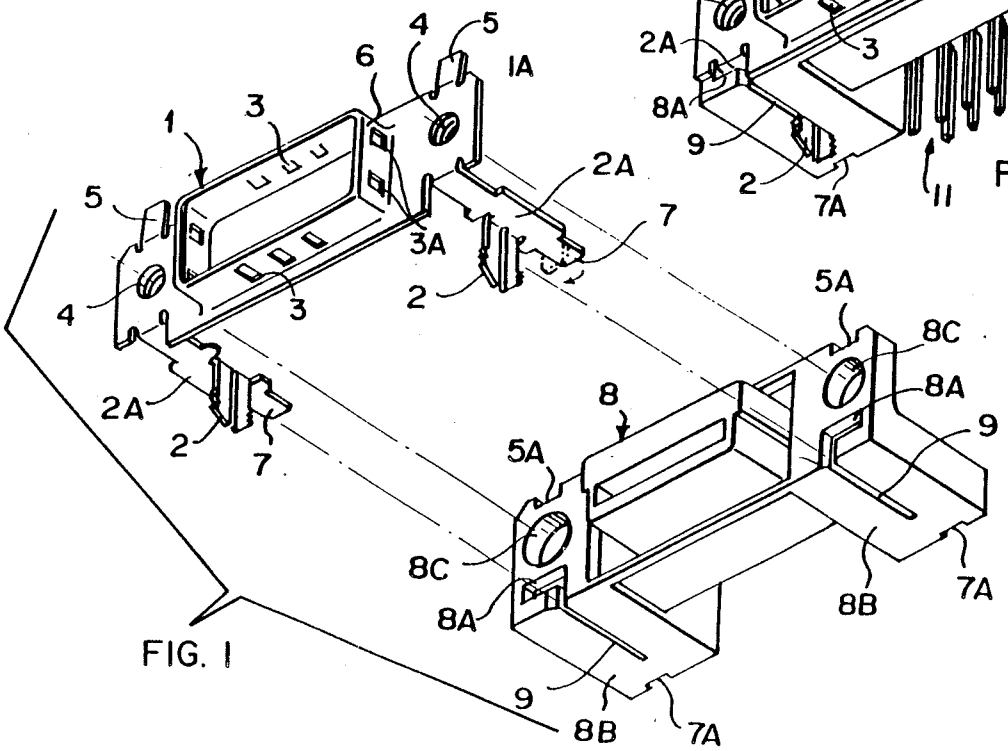
FIG. 1 is an exploded perspective view showing a shield member and a connector housing.

A shield member according to the present invention is formed from a sheet of suitable conductive metal and comprises a shield section 1A covering a front surface of an electrical connector housing as well as mounting members 2 integrally formed therewith. Mounting members 2 are utilized to mount the electrical connector onto a circuit board and are soldered thereto to establish a ground connection therewith. Leg sections 2A extend in rearward direction from shield section 1A with mounting members 2 being folded downward at a right angle from leg sections 2A.

A shroud 6 extends forward to shield section 1A. Shroud 6 may be rectangular in shape and have indents 3 located in upper and lower walls thereof. Shroud 6, in the preferred embodiment, has retaining apertures 3A in the sidewalls thereof for receiving latching members of a complementary connector. Further, at both sides of shield section 1A are located threaded holes 4 for securing the connector to a panel. Leg sections 2A are located underneath threaded holes 4. Lugs or securing members 5 are located at the upper end of and on both sides of shield section 1A in alignment with threaded holes 4 and lugs or securing members 7 are located at the rear ends of leg sections 2A. These lugs 5, 7 are adapted to be folded for engagement with recesses 5A, 7A at the upper and back ends of housing 8.

At the lower right and left sides of housing 8 are located L-shaped slots 8A which respectively receive leg sections 2A and mounting members 2. Slots 9 extend from the front of housing 8 toward the rear along surfaces 8B of housing 8 with slots 9 in communication with respective slots 8A to receive mounting members 2.

When shield member 1 is assembled to housing 8, shield section 1A extends along and engages the front surface of housing 8, and leg sections 2A with mounting members 2 are inserted in slots 8A, 9 and the front surface of housing 8.

After shield member 1 is placed onto housing 8, lugs 5, 7 are bent into respective recesses 5A, 7A of housing 8 to secure shield member 1 and integral mounting members 2 to housing 8, as shown in FIG. 2. Electrical contacts 10 are assembled in housing 8 by a separate process, completing shielded electrical connector 11 as shown in FIG. 2.

Housing 8 contains holes 8C to accommodate receiving the screws for fixing the connector to a panel through aligned threaded holes 4 of shield section 1A. Thus, the connector can be fixed to a panel by inserting the fixing screws from the front surface of shield member 1. Shielded connector 11 can be mounted onto a circuit board with mounting members 2 being inserted in corresponding apertures in the circuit board and providing an interference fit therein, thereby temporarily maintaining the connector on the board whereby mounting members 2 can then be soldered to the ground path or land on the board. As can be discerned mounting members 2 constitute a pair of spaced legs which act as spring members. The bottom edges of the spaced legs are tapered from inner edges to outer edges to enable the pair of spaced legs to be readily inserted into the board hole. The outer edges are serrated to frictionally engage the sidewalls of the hole along the thickness of the printed circuit board, thereby maintaining the connector on the circuit board.

Since a shield member according to this invention is composed of a shield section 1A and mounting members 2 formed integrally therewith, a more reliable electrical continuity therebetween can be ensured. The shield member with the integral mounting members 2, can be easily secured to housing 8 by bending lugs 5, 7 into engagement with the housing. Therefore, the man-hours required for assembly of the shield member having integral mounting members onto the connector can be substantially reduced, whereby a very reliable shielded electrical connector is produced which is easily mounted onto a circuit board by the integral mounting members which temporarily secure the connector to a printed circuit board by frictional engagement in apertures therein and more permanently upon being soldered to a ground plane, thus forming an excellent ground connection therewith.

What is claimed is:

1. A shielded electrical connector for mounting onto a circuit board comprising a dielectric housing having electrical contacts secured therein for electrical connection to conductive areas on the circuit board and a shield member secured onto the housing, wherein said shield member includes a shield section extending along said housing and having integral leg sections extending along said housing, said leg sections including integral mounting sections extending outwardly from a bottom surface of said housing for engagement with holes in the circuit board to maintain the shielded connector on the circuit board, said housing having first slots along which said leg sections extend and further slots in communication with said first slots through which said mounting members extend.

2. A shielded electrical connector for mounting onto a circuit board, comprising:

a dielectric housing having electrical contacts secured therein for electrical connection to conductive areas on the circuit board, said housing including slot means;

a metal shield member including a shield section extending along said housing and integral leg sections disposed in said slot means; and integral mounting sections of said leg sections extending outwardly from said slot means and from a mounting surface of said housing for engagement with holes in the circuit board to maintain the shielded connector on the circuit board.

3. A shielded electrical connector as claimed in claim 2, wherein said slot means include first slots along which said leg sections extend and second slots in communication with said first slots through which the mounting members extend.

4. A shielded electrical connector as claimed in claim 1, wherein said mounting sections each comprises a pair of spaced legs having tapered free ends and serrated outer edges.

5. A shielded electrical connector as claimed in claim 1, wherein said shield member includes lugs disposed in recesses of said housing securing said shield member onto said housing.

* * * * *